US005823209A

United States Patent [19]

Kleye et al.

[11] Patent Number: 5,823,209

[45] Date of Patent: Oct. 20, 1998

[54] APPARATUS FOR THE GUIDING OF AN ELONGATED ELEMENT

[75] Inventors: Karsten Kleye, Wesel; Wilfried Boden, Stradow, both of Germany

[73] Assignee: Bergemann GmbH, Wesel, Germany

[21] Appl. No.: 741,572

[22] Filed: Oct. 31, 1996

Related U.S. Application Data

[60] Continuation-in-part of Ser. No. 721,748, Sep. 30, 1996, abandoned, which is a division of Ser. No. 424,900, Apr. 19, 1995, abandoned.

[30] Foreign Application Priority Data

Apr. 29, 1994 [DE] Germany ..... 44 15 010.5

[51] Int. Cl.[6] ..... B08B 3/00; B08B 7/04; A46B 13/00

[52] U.S. Cl. ..... 134/57 R; 134/58 R; 134/18; 15/318

[58] Field of Search ..... 134/57 R, 58 R, 134/18; 15/318

[56] References Cited

U.S. PATENT DOCUMENTS

| | | | |
|---|---|---|---|
| 4,718,376 | 1/1988 | Leroneil et al. | 122/390 |
| 4,803,959 | 2/1989 | Sherrick et al. | 122/379 |
| 5,320,073 | 6/1994 | Silcott et al. | 122/392 |
| 5,337,438 | 8/1994 | Brown et al. | 15/318.1 |
| 5,416,946 | 5/1995 | Brown et al. | 15/318 |

*Primary Examiner*—Mary E. Mosher
*Assistant Examiner*—Ali R. Salimi
*Attorney, Agent, or Firm*—Max Fogiel

[57] ABSTRACT

An elongated element, for example, a soot blower for the cleaning of wall surfaces, is guided along a predetermined, meandrical blow figure. The element is supported in two spaced-apart cardanic joints (3, 4) the first of which is stationary and the second axially moveable on a first spindle (6) the ends of which are axially moveable on two parallel second spindles (8). The first and one of the second spindles (6, 8) are each provided with two non-mechanical, inductive proximity switches or end switches (11–14) which are connected with a controller (16) having a memory and being programmable. The end switches (13, 14) detect a reference point in horizontal and vertical directions, and two end switches (11, 12) detect the rotations of the spindles (6, 8) as a measure of the distance travelled by the second cardanic joint (4). The impulses of the end switches.(11, 12) which are proportional to the distance travelled are compared in the controller (16) with the preselected blow figure and the spindles (6, 8) are controlled according to the blow figure.

6 Claims, 3 Drawing Sheets

APPARATUS FOR THE GUIDING OF AN ELONGATED ELEMENT

CROSS-REFERENCES TO RELATED APPLICATIONS

This is a continuation-in-part of application Ser. No. 08/721,748 filed Sep. 30, 1996, now abandoned, which is a divisional of 08/424,900 filed Apr. 19, 1995, now abandoned.

BACKGROUND OF THE INVENTION

One example of such an elongated element is the lance employed in a blower to scrub soot from a piping-slab wall that conveys a heat-exchange fluid and is subjected to a dusty flue gas (WIPO 03/12398). The jet of water emerging from the blower frees the wall of deposits of dust. To allow the jet to reach every point on the wall, the exit end of the lance describes first a horizontal and then a vertical stretch of a meandering path. This configuration is ensured by means of two spindles. One spindle rotates at constant speed for a prescribed duration, subsequent to which the other is actuated. The spindles sometimes operate unreliably in aggressive situations due to contamination and wear. Since they are time-dependent, moreover, they sometimes change direction before they should. The wall will not be effectively scrubbed.

DD Patent 281 452 proposes controls allowing such a blower to scrub only an area of contamination that is limited in extent. A configuration matching the structure and the visually determined level of contamination is entered in the controls. The configuration is then forwarded to the spindles by way of a signal generator and distance detector.

SUMMARY OF THE INVENTION

The object of the present invention is a method of controlling a generic component mounted in two universal joints such that it will precisely adhere to a prescribed configuration including several changes of direction.

The controls in accordance with the present invention is path-dependent instead of time-dependent, which allows precise guidance of the articulation and positioning of the moving component. Distance is detected strictly by the mechanisms that drive the component. Such controls provide an advantageous opportunity to control the three-phase motors that drive the spindles by frequency regulation. Such speed controls make it possible to vary how long the jet is aimed at a particular area of the wall in accordance with how dirty that area is. Speed variability is also a good idea because, since the controls in accordance with the present invention are strictly path-dependent, how rapidly the jet travels over the wall will in no way affect the precision of the configuration.

BRIEF DESCRITION OF THE DRAWINGS

One embodiment of the present invention will now be specified by way of example with reference to the accompanying drawing, wherein FIG. 1 is a side view of a soot-removal blower, FIG. 2 is a block diagram, and FIG. 3 illustrates a soot-removal configuration.

DESCRIPTION OF THE PREFERRED EMBODIMENTS

Figure 1:
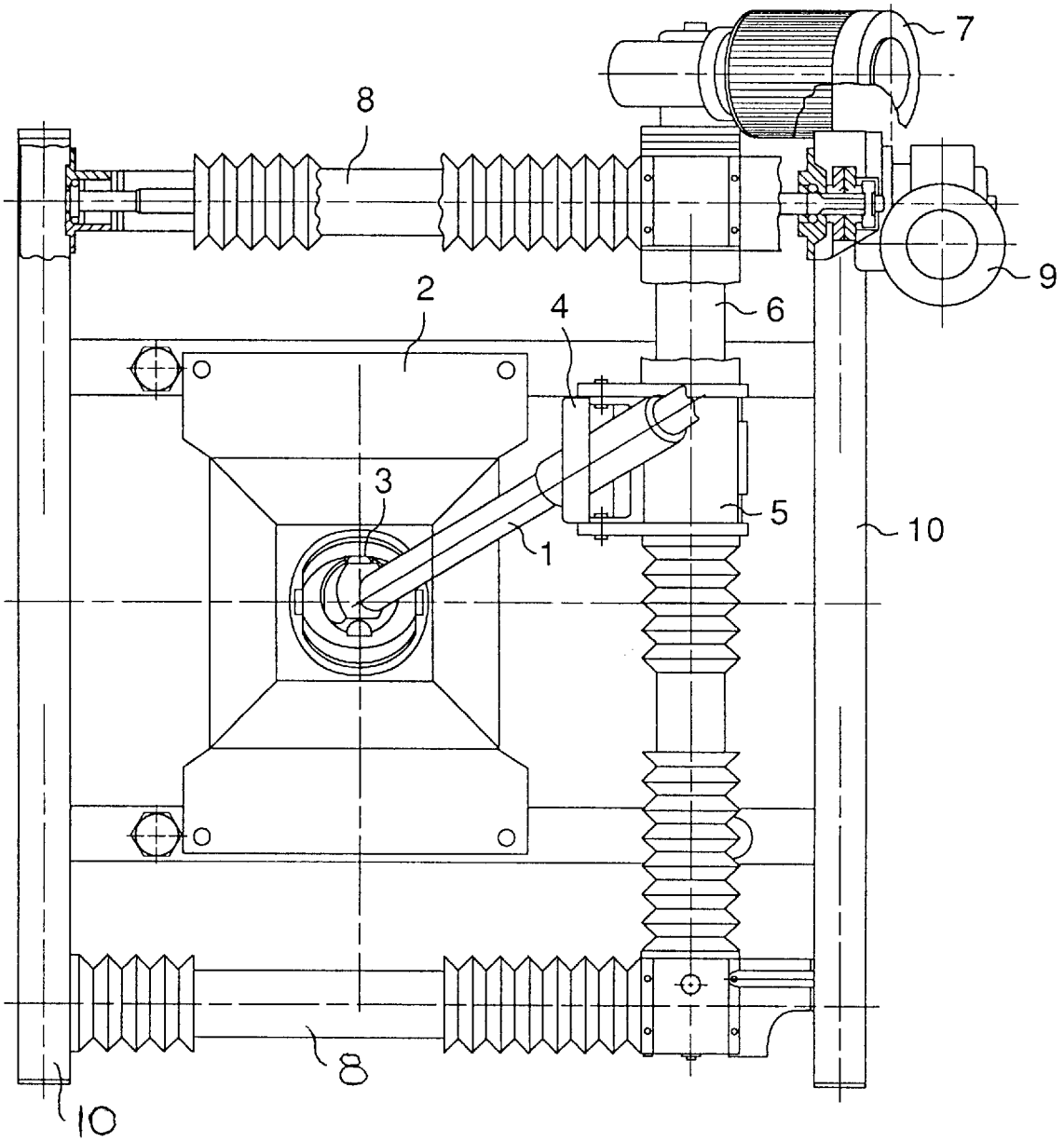

A soot-removal blower in the form of a water-lance blower includes a lance 1 that conveys a blowing agent in the form of water. The exit end of lance 1 extends through an opening protected by a cover 2 into the piping-slab walled combustion chamber of a steam generator. Lance 1 is secured in cover 2 by a universal joint 3. The other end of lance 1 slides axially in and out of another second universal joint 4. Second universal joint 4 is attached to an alignment sleeve 5 that slides back and forth along a spindle 6. Spindle 6 is driven by a three-phase braking motor 7. The ends of the spindle slide back and forth along two parallel spindles 8. Another three-phase braking motor 9 drives one spindle 8 directly and the other by way of a chain 10. The rotation of spindle 6 vertically displaces alignment sleeve 5 along with second universal joint 4. Lance 1, which is mounted in joints 3 and 4, will accordingly sweep along a horizontal axis, and the jet leaving lance 1 will be shifted vertically. The rotation of parallel spindles 8 will similarly generate horizontal motion of spindle 6 and of the second universal joint 4 mounted thereon. Lance 1 will accordingly swing around a vertical axis, and the jet leaving lance 1 will move horizontally.

Figure 2:
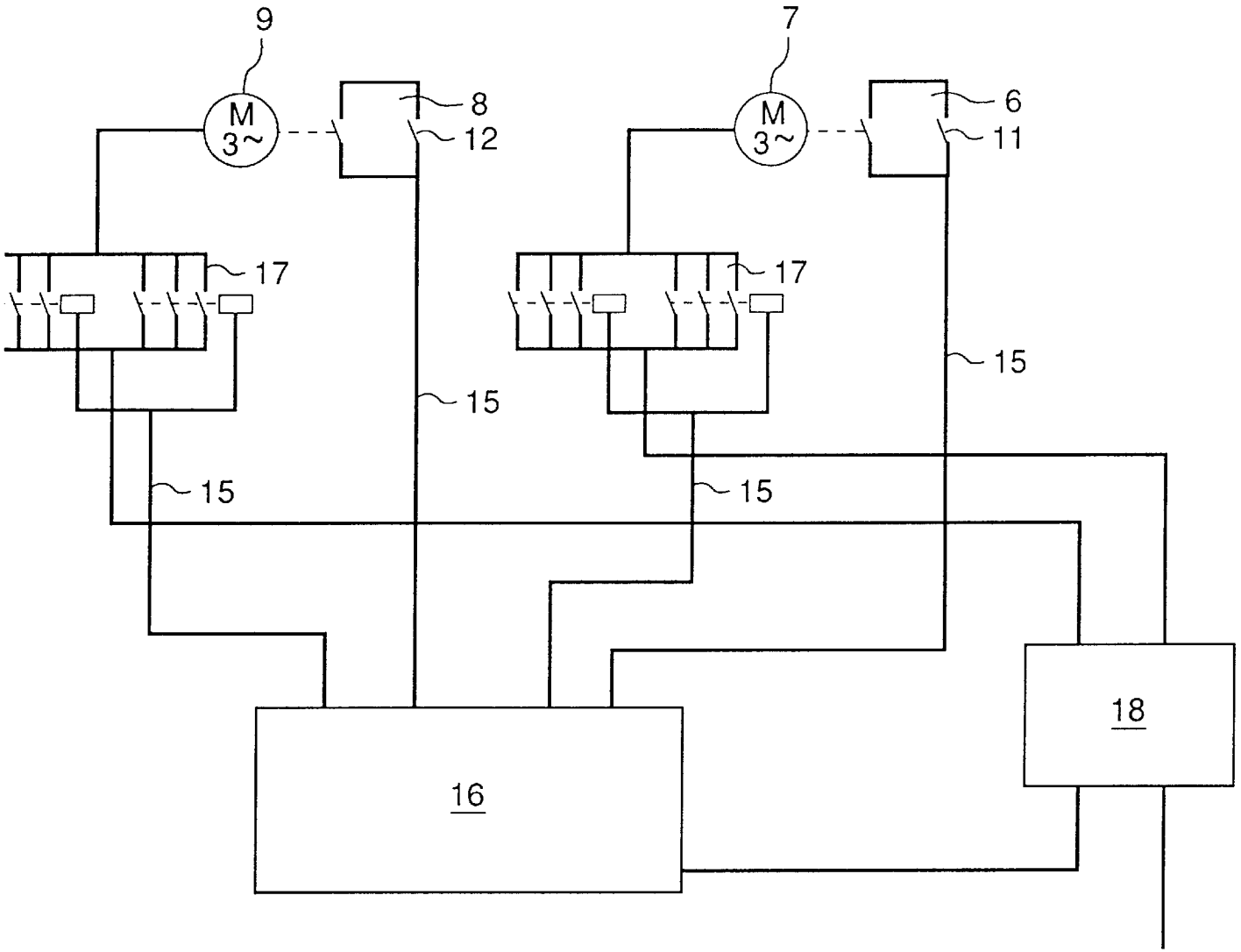
Figure 3:
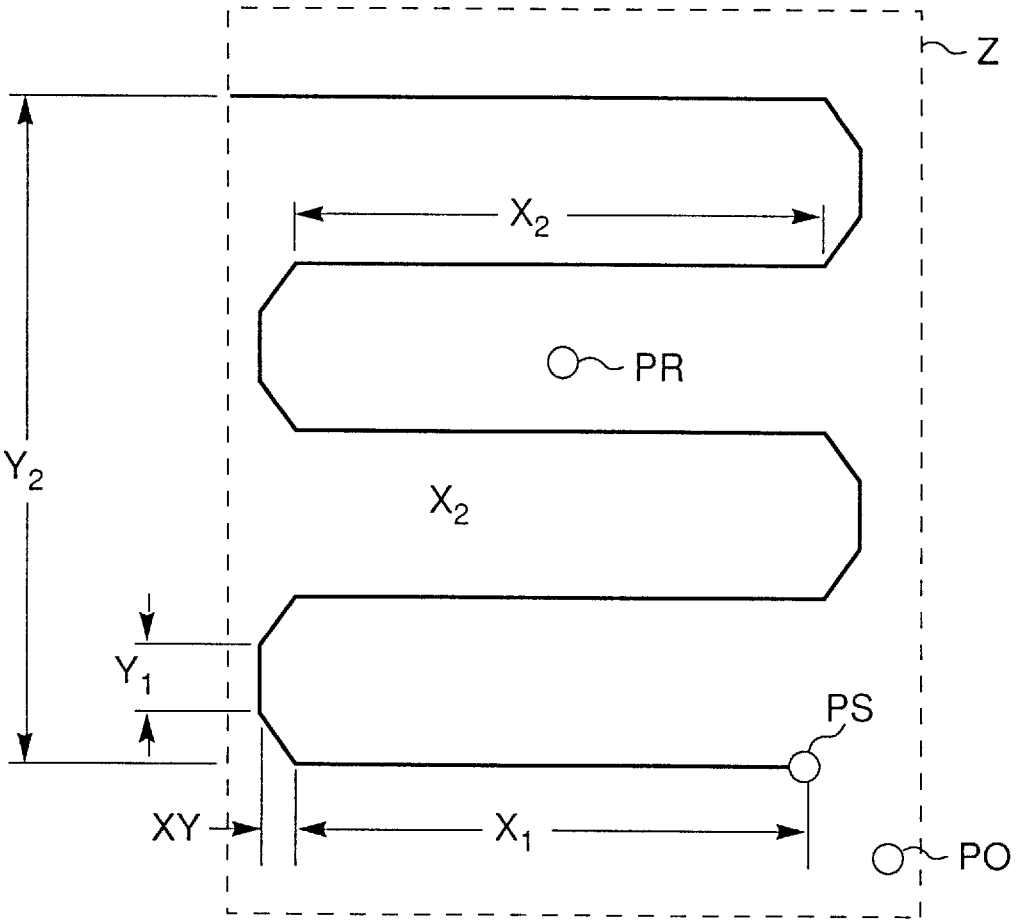

The alternate actuation of spindles 6 and 8 will displace second universal joint 4 and hence swing lance 1, and the jet leaving the lance will describe the configuration illustrated in FIG. 3 on the wall of the combustion chamber facing the lance. This configuration comprises vertical and horizontal sections connected by transitions. The configuration also includes a reference point PO representing the origin of the coordinate system. The path between point PS of departure and the first horizontal transition is $x_1$, and that between the left-hand transition and the right-hand transition along the horizontal is $x_2$. Spindles 8 are in operation at this time. The distance the jet travels vertically while spindle 6 is in operation is $y_1$. The distance xy is the component of the transition during which all the spindles are in operation. The upper limit of the configuration is represented by $Y_2$. Box z represents the limit of the overall configuration as dictated by the mechanisms. Associated with spindle 6 and with one of the spindles 8 illustrated in FIG. 2 are two remote travel pick-ups 11, 12, 13, and 14. Distance detectors of this type are in themselves known and can constitute wheels with several vanes mounted on them. The wheels are connected to the spindles and rotate along with them through magnetic fields generated by end or proximity induction switches. The field varies and generates a pulse every time such a vane travels through it. The number of pulses represents the number of rotations executed by the spindles. The number of rotations represents in turn how far second universal joint 4 has traveled along spindles 6 and 8. Every motion of second universal joint 4 inclines lance 1 at a particular angle. The pulses detected by the distance detectors accordingly represent both the position and motion of lance 1 and accordingly of the jet leaving the lance. Proximity switches 13 and 14 accordingly measure by way of pulses the rotations of spindles 6 and 8. The associated geometry makes it possible to calculate the path traveled by second universal joint 4. Proximity switches 11 and 12 determine reference point PO.

Proximity switches 11 through 14 communicate by way of lines 15 with programmable-memory controls 16. The configuration (represented in FIG. 3) that the jet is intended to follow is stored in controls 16. How this happens will now be specified. The dimensions of the wall area to be cleaned are known from the designs along with the constant distance of lance 1 from the wall. The configuration that the jet is intended to describe on the facing wall results from the slope of the lance and geometrically accordingly from a three-dimensional angle. Every point on the wall can be determined by the momentary slope of lance 1 in conjunction with its fixed distance from the wall. The geometric ratio is entered in the controls as a sequence of pulses. The change in the slope of the lance can be derived from the path traveled by second universal joint 4 as spindles 6 and 8 rotate. The pulses detected by proximity switches 13 and 13 can accordingly be compared in controls 16 with the stored configuration.

Each motor 7 and 9 is equipped with a contactor 17 for the back-and-forth rotation of spindles 6 and 8. Contactors 17 communicate with controls 16 by way of lines 15. A frequency converter 18 communicates with contactors 17 and lines 15.

Once the starter has been triggered, reference point PO is entered in order to zero the system. Arrival at point PO in the X and Y directions is indicated by proximity switches 11 and 12. Once point PS of departure is occupied, the supply of blowing fluid to the soot remover is initiated. The pulses obtained from proximity switches 13 and 14 are exploited to count the horizontal and vertical components of the actual path traveled and compared with the ideal values stored in the controls. When the actual values coincide with the ideal values, the configuration is complete and the next step is initiated. Once the configuration has been entirely traced, the supply of fluid is discontinued and the point PR of rest entered.

If the jet is intended to operate for a different duration, frequency converter 18 will change the speed of motors 7 and 9. Such a change will have no effect on how the configuration is described because the proximity switches 11 and 12 that detect the stretches traveled operate independently of how rapidly the configuration is described. The aforesaid controls can be employed not only for soot removers but for any other elongated components mounted in two universal joints.

The spindles may be actuated, furthermore, by frequency-controlled three-phase braking motors which have a speed of rotation adjustable by the controller.

We claim:

1. Apparatus for controlling an elongated member, comprising: an elongated member emitting a specifically-configured jet to blow soot off specific areas of a wall; a first universal joint and a second universal joint separated from said first joint for securing said elongated member; said first universal joint being stationary; a first spindle, said second universal joint traveling back and forth along said first spindle; a second spindle and a third spindle parallel to said second spindle, said second universal joint having ends traveling back and forth along said second spindle and said third spindle; a first pair of inductive proximity sensors cooperating with said first spindle; a second pair of inductive proximity sensors cooperating with one of said second and third spindles, rotation of said first spindle being detected through pulses emitted by a first one of said first pair of inductive proximity sensors, rotation of said one of said second and third spindles being detected through pulses emitted by a first one of said second pair of inductive proximity sensors, distance traveled by said second universal joint along said second and third spindles being measured by number of rotations; a memory-programmable controller for receiving a configuration of said specifically-configured jet for setting a distance of said second universal joint from said wall in form of vertical and horizontal motions of said second universal joint; means for comparing the pulses from said first sensor to said configuration received by said controller; means for adjusting the second ones of each said pair of sensors vertically and horizontally to a fixed reference point on said wall; and means for actuating the spindles in accordance with said configuration entered into said controller and in accordance with said reference point.

2. Apparatus for controlling an elongated member, comprising: an elongated member emitting a specifically-configured jet to blow soot off specific areas of a wall; a first universal joint and a second universal joint separated from said first joint for securing said elongated member; said first universal joint being stationary; a first spindle, said second universal joint traveling back and forth along said first spindle; a second spindle and a third spindle parallel to said second spindle, said first spindle having ends traveling back and forth along said second spindle and said third spindle; a first pair of inductive proximity sensors cooperating with said first spindle; a second pair of inductive proximity sensors cooperating with one of said second and third spindles, rotation of said first spindle being detected through pulses emitted by a first one of said first pair of inductive proximity sensors, rotation of said one of said second and third spindles being detected through pulses emitted by a first one of said second pair of inductive proximity sensors distance traveled by said second universal joint along said first spindle and via said first spindle along said second and third spindles being measured by number of rotations; a further first inductive proximity sensor associated with said first spindle and a further second inductive proximity sensor associated with one of said second spindles for establishing a vertical and horizontal reference point.

3. Apparatus as defined in claim 1, wherein said elongated member is a lance.

4. Apparatus as defined in claim 1, including frequency-controlled three-phase braking motors for actuating said spindles, said motors having a speed of rotation adjustable by said controller.

5. Apparatus as defined in claim 2, wherein said elongated member is a lance.

6. Apparatus as defined in claim 2, including frequency-controlled three-phase braking motors for actuating the spindles, said motors having a speed of rotation adjustable by said controller.

* * * * *